US009303478B2

(12) United States Patent
Scruggs et al.

(10) Patent No.: US 9,303,478 B2
(45) Date of Patent: Apr. 5, 2016

(54) DOWNHOLE TOOL AND METHOD FOR PASSING CONTROL LINE THROUGH TOOL

(71) Applicant: Weatherford Technology Holdings, LLC, Houston, TX (US)

(72) Inventors: Justin R. Scruggs, Houston, TX (US); Charles D. Parker, Sugar Land, TX (US); Brandon C. Goodman, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 60 days.

(21) Appl. No.: 14/178,004

(22) Filed: Feb. 11, 2014

(65) Prior Publication Data

US 2015/0226023 A1 Aug. 13, 2015

(51) Int. Cl.

| | |
|---|---|
| ***E21B 23/06*** | (2006.01) |
| ***E21B 33/12*** | (2006.01) |
| ***E21B 23/01*** | (2006.01) |
| ***E21B 17/02*** | (2006.01) |
| ***E21B 33/124*** | (2006.01) |
| ***E21B 43/26*** | (2006.01) |
| ***E21B 47/06*** | (2012.01) |
| ***E21B 47/12*** | (2012.01) |
| ***E21B 49/08*** | (2006.01) |
| ***E21B 33/128*** | (2006.01) |

(52) U.S. Cl.

CPC ..... *E21B 23/01* (2013.01); *E21B 17/026* (2013.01); *E21B 33/124* (2013.01); *E21B 33/1208* (2013.01); *E21B 33/128* (2013.01); *E21B 43/26* (2013.01); *E21B 47/06* (2013.01); *E21B 47/065* (2013.01); *E21B 47/12* (2013.01); *E21B 49/087* (2013.01)

(58) Field of Classification Search

CPC ..... E21B 33/1208; E21B 23/06; E21B 34/10; E21B 33/127; E21B 33/12; E21B 33/128

See application file for complete search history.

(56) References Cited

U.S. PATENT DOCUMENTS

| | | | |
|---|---|---|---|
| 2,253,092 | A | 8/1941 | Pranger |
| 4,627,490 | A | 12/1986 | Moore |
| 5,096,209 | A | 3/1992 | Ross |
| 5,803,170 | A | 9/1998 | Garcia-Soule et al. |

(Continued)

FOREIGN PATENT DOCUMENTS

| | | | |
|---|---|---|---|
| EP | 1554459 | B1 | 1/2007 |
| WO | 2011/012838 | A2 | 2/2011 |

OTHER PUBLICATIONS

EPO Extended European Search Report dated Nov. 10, 2015, for EPO Application No. 15154366.7.

(Continued)

*Primary Examiner* — Zakiya W Bates

(74) *Attorney, Agent, or Firm* — Patterson & Sheridan LLP

(57) ABSTRACT

A method of deploying a tool in a wellbore includes installing a tool body at an upper end of a tubular string extending from a wellbore, the body having at least one control line groove formed on its outer surface with the at least one control line housed therein. The method also includes providing an assembly strung on the at least one control line. The assembly includes an element with at least one ring on each end thereof; at least one ring on each end of the element; a locking ring at an upper end of the assembly. The method further includes installing the assembly over the body to house the at least one control line between the body and the assembly.

20 Claims, 11 Drawing Sheets

(56) References Cited

U.S. PATENT DOCUMENTS

| | | | | |
|---|---|---|---|---|
| 6,173,788 | B1 | 1/2001 | Lembcke et al. | |
| 6,325,144 | B1 | 12/2001 | Turley et al. | |
| 7,216,720 | B2 | 5/2007 | Zimmerman | |
| 7,264,061 | B2 | 9/2007 | Dybevik et al. | |
| 7,562,709 | B2 | 7/2009 | Saebi et al. | |
| 7,699,115 | B2 | 4/2010 | Baaijens et al. | |
| 7,762,322 | B2 | 7/2010 | Andersen et al. | |
| 7,762,344 | B2 | 7/2010 | Courville et al. | |
| 7,784,532 | B2 | 8/2010 | Sevre et al. | |
| 7,836,960 | B2 | 11/2010 | Patel et al. | |
| 7,896,070 | B2 | 3/2011 | Lovell | |
| 7,997,338 | B2 | 8/2011 | Foster et al. | |
| 8,006,773 | B2 | 8/2011 | Courville et al. | |
| 8,083,000 | B2 | 12/2011 | Nutley et al. | |
| 8,225,861 | B2 | 7/2012 | Foster et al. | |
| 8,371,374 | B2 | 2/2013 | Foster et al. | |
| 8,596,369 | B2 | 12/2013 | Andersen et al. | |
| 2006/0048950 | A1 | 3/2006 | Dybevik et al. | |
| 2007/0012436 | A1 | 1/2007 | Freyer | |
| 2007/0158060 | A1 | 7/2007 | Baaijens et al. | |
| 2009/0250228 | A1 | 10/2009 | Loretz et al. | |
| 2010/0065284 | A1 | 3/2010 | Freyer | |
| 2010/0230902 | A1 | 9/2010 | Castillo et al. | |
| 2011/0139458 | A1* | 6/2011 | Shafiq et al. | 166/313 |
| 2011/0209873 | A1* | 9/2011 | Stout | 166/320 |
| 2013/0008643 | A1 | 1/2013 | Castillo et al. | |
| 2013/0283593 | A1 | 10/2013 | Castillo et al. | |
| 2014/0014373 | A1* | 1/2014 | Richards | 166/385 |
| 2014/0083683 | A1* | 3/2014 | Tips et al. | 166/250.01 |

OTHER PUBLICATIONS

Canadian Office Action dated Jan. 4, 2016, for Canadian Patent Application No. 2,881,288.

* cited by examiner

DOWNHOLE TOOL AND METHOD FOR PASSING CONTROL LINE THROUGH TOOL

BACKGROUND OF THE INVENTION

1. Field of the Invention

Embodiments of the present invention generally relate to a downhole tool. More particularly, the invention relates to a downhole tool housing at least one control line extending therethrough.

2. Description of the Related Art

Intelligent completions require the use of control lines in order to transmit real time pressure and temperature data from within the various zones of multi-zonal completions. In this type of completion, it is desirable to run the fiber optic-containing control line from the surface to a location in the wellbore without cutting and/ or splicing in order to minimize signal loss that results from splicing fiber optic cables. In one embodiment, it is desired to develop a well bore packer in which a control line (with or without a fiber optic cable inside) can be run past the packer without splicing while still being able to provide a pressure-tight seal around the control line and between the string and wellbore, thus providing adequate zonal isolation between the zones of a multi-zonal completion.

What is needed is an effective way to allow control lines to pass through a downhole tool, like a packer, without being cut and/or spliced and also ensuring the lines are not damaged before, during and after the tool operates.

SUMMARY OF THE INVENTION

The present invention generally includes a tool and a method of use. In one embodiment, a method of deploying a tool in a wellbore is disclosed and consists of installing a tool body at an upper end of a tubular string extending from a wellbore, the body having at least one control line groove formed on its outer surface for housing at least one control line, the at least one control line housed therein; providing an assembly, the assembly strung on the at least one control line and including a compressible element with at least one ring on each end thereof. The method further includes installing the assembly over the body whereby the at least one control line is housed between the body and the assembly. Thereafter, a locking ring is installed at an upper end of the assembly.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention relates to a downhole tool for use with control lines in a manner that permits the tool to operate without damaging the lines and permits assembly, run-in and operation of the tool without splicing or cutting the lines. In this disclosure "control lines" or "lines" is used generally and relates to any line, cord, wire, etc. that runs from one end of a tubular string towards a opposite end.

Figure 1:
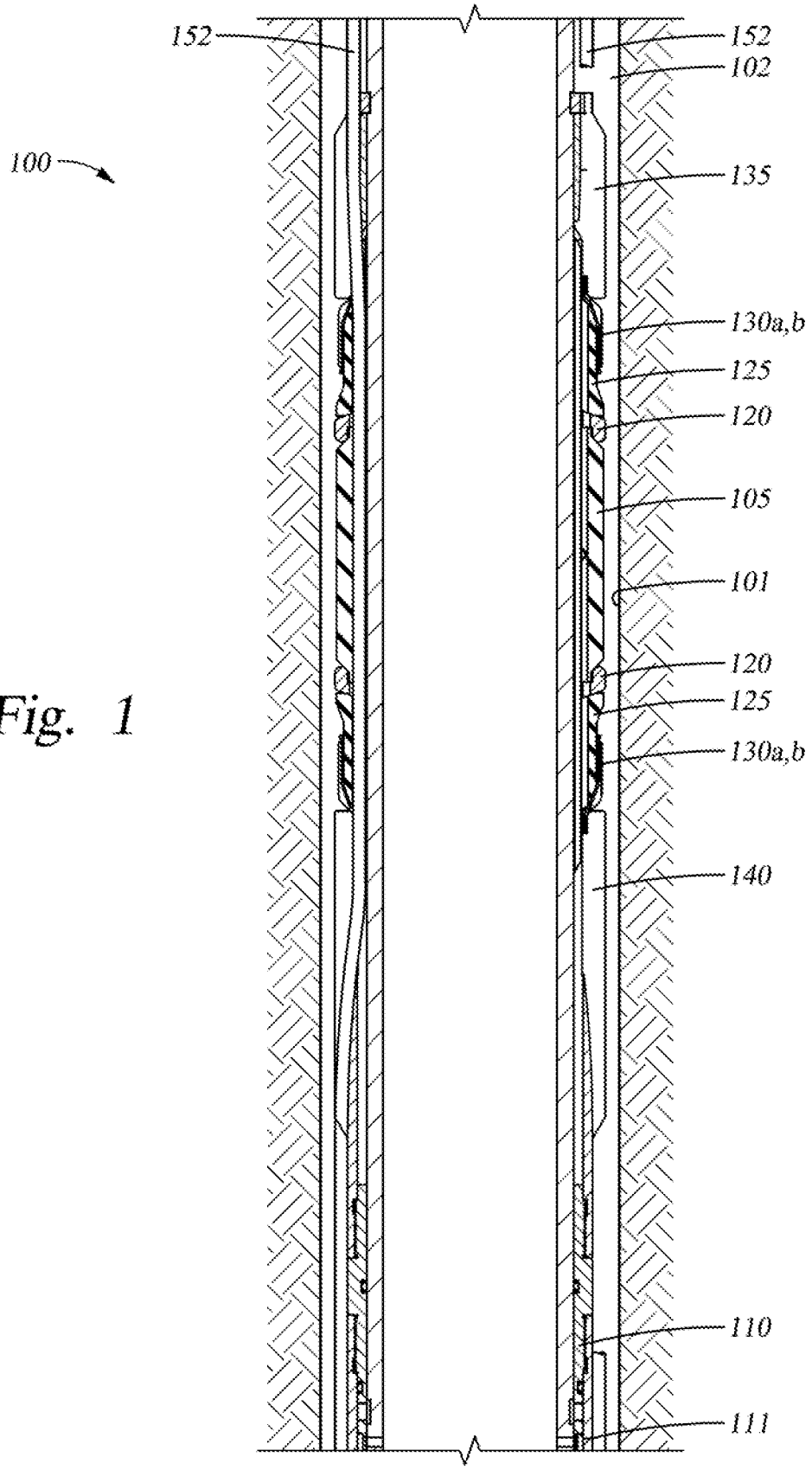
FIG. 1 is a section view of one embodiment of a tool shown in a wellbore in an unset condition.
Figure 2:
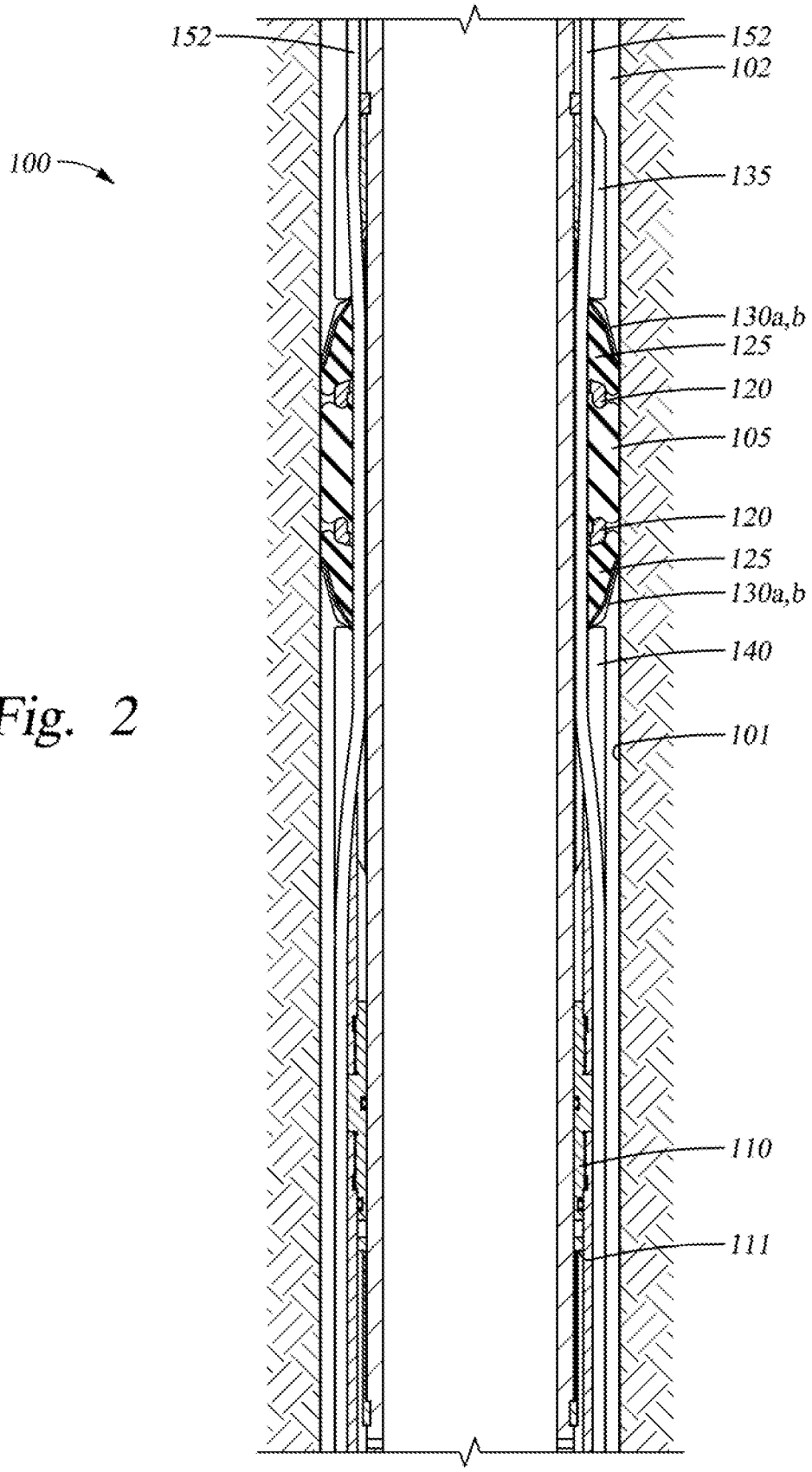
FIG. 2 shows the tool in a set condition.

In one embodiment, the tool 100 is a packer that is shown in a wellbore 101 in FIG. 1 in an unset position and a set position in FIG. 2 in which an annular area 102 formed between the tool and the wellbore is sealed by an expandable sealing element 105. In the embodiment shown, the tool 100 is hydraulically operated by a setting mechanism that includes a piston 110 having a piston surface 111 selectively acted upon by a source of pressurized fluid from an interior of the packer 100. Once the piston 110 is moved and a sealing element 105 compressed, the setting mechanism is retained in the set position by a ratcheting mechanism (not shown) well known in the art.

Figure 7:
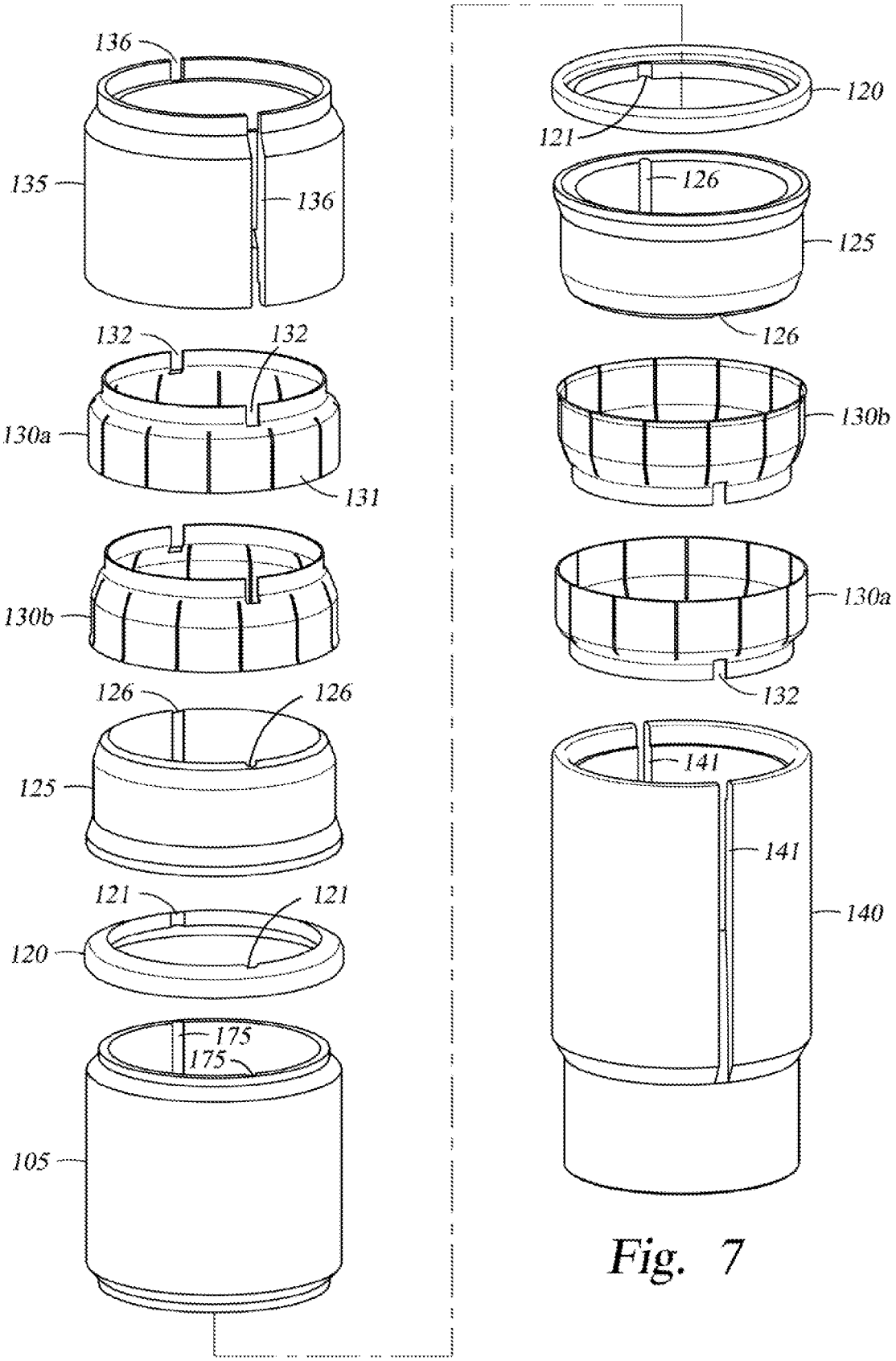
FIG. 7 is an exploded view of the tool showing various parts thereof and their relationship to each other.

FIGS. 1 and 2 illustrate various portions of the tool including, at each end of the sealing element 105, a metallic ring 120, a deformable sealing ring 125 and two castellated rings 130*a*, 130*b* each having petals 131 formed in one end thereof to facilitate deformation as the tool is set and the portions are compressed (FIG. 7). While castellated rings are shown in the present embodiment, the invention could just as easily be used with solid rings that are thin enough to deform as the tool is set. The position of the various portions in the set position is shown in FIG. 2. At each end, the components are retained by a locking ring 135, 140. Two control lines 152 are illustrated with a portion of the line on the right side of FIG. 1 removed to facilitate the view of the other components.

Figure 3:
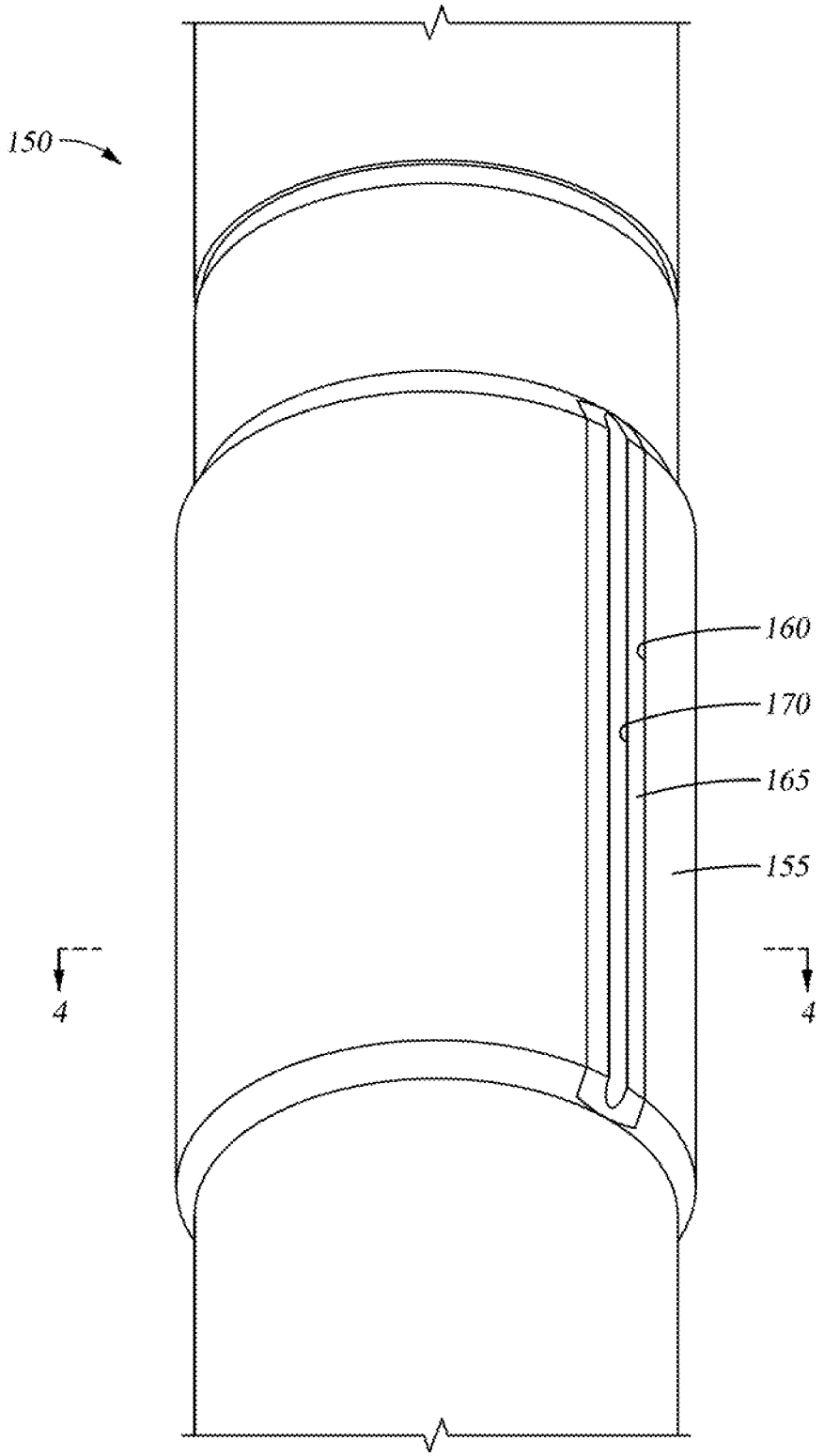
FIG. 3 is a perspective view of a body of the tool.
Figure 4:
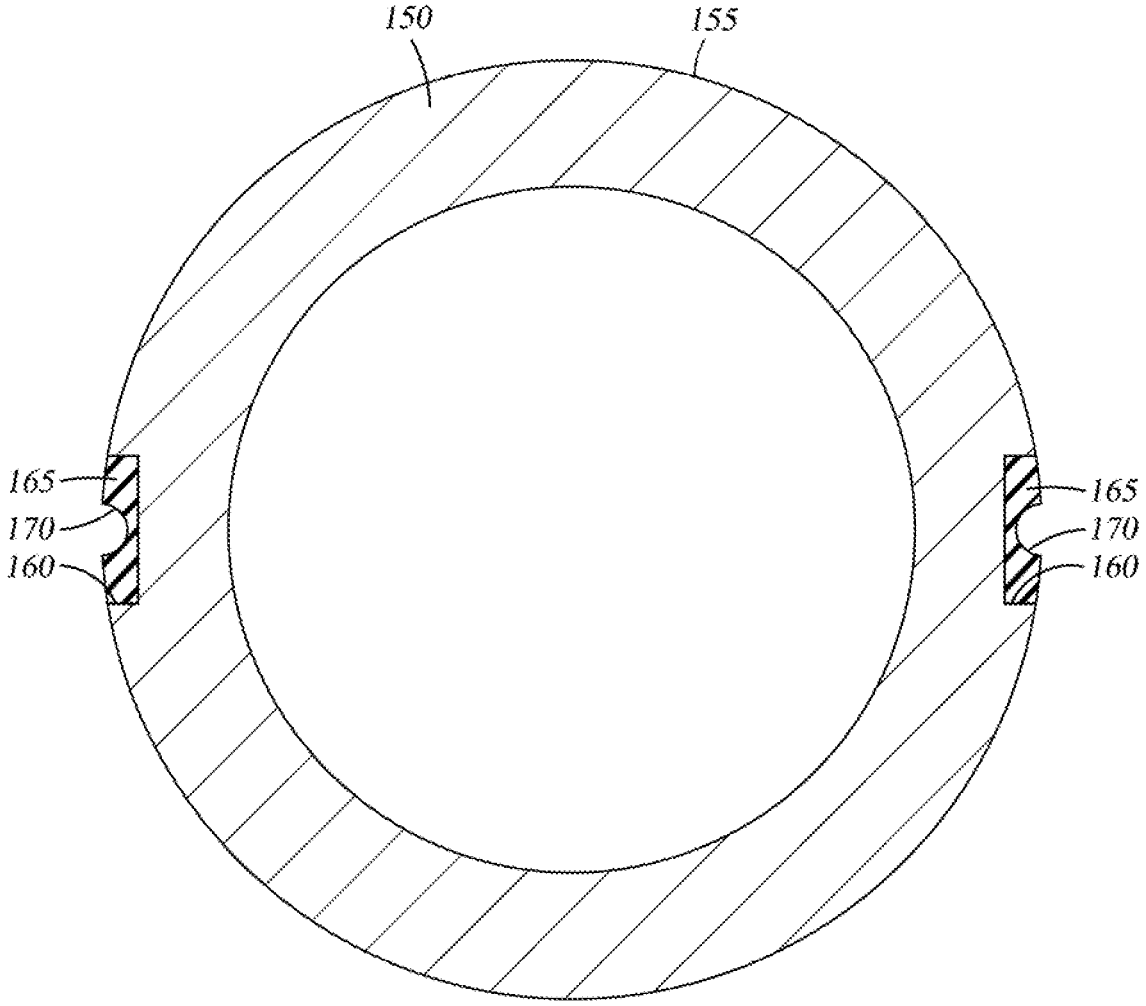
FIG. 4 is a section view of the body taken through an enlarged diameter portion thereof at a line 4-4 in FIG. 3.

The components of the tool 100 are constructed and arranged to house at least one control line 152 in a manner preventing its damage as the tool is run-in and set in the wellbore 101. FIG. 3 is a perspective view of a body 150 or mandrel portion of the tool 100 having an enlarged diameter portion 155 with a longitudinal groove 160 formed therein. Illustrated in the groove 160 is an insert 165 made of an elastomeric material that itself includes a control line groove 170 intended to house the lower half of a control line 152 (not shown) as it extends the length of the enlarged diameter portion 155 of the body 150. FIG. 4 is a section view of the body 150 taken through the enlarged diameter portion 155. FIG. 4 illustrates the arrangement that houses two separate lines 152, one on each side of the tool 100. Visible in the Figure are two grooves 160, two inserts 165 and two control line grooves 170 that are sized in a manner whereby each one houses a lower ½ of a control line 152.

Figure 5:
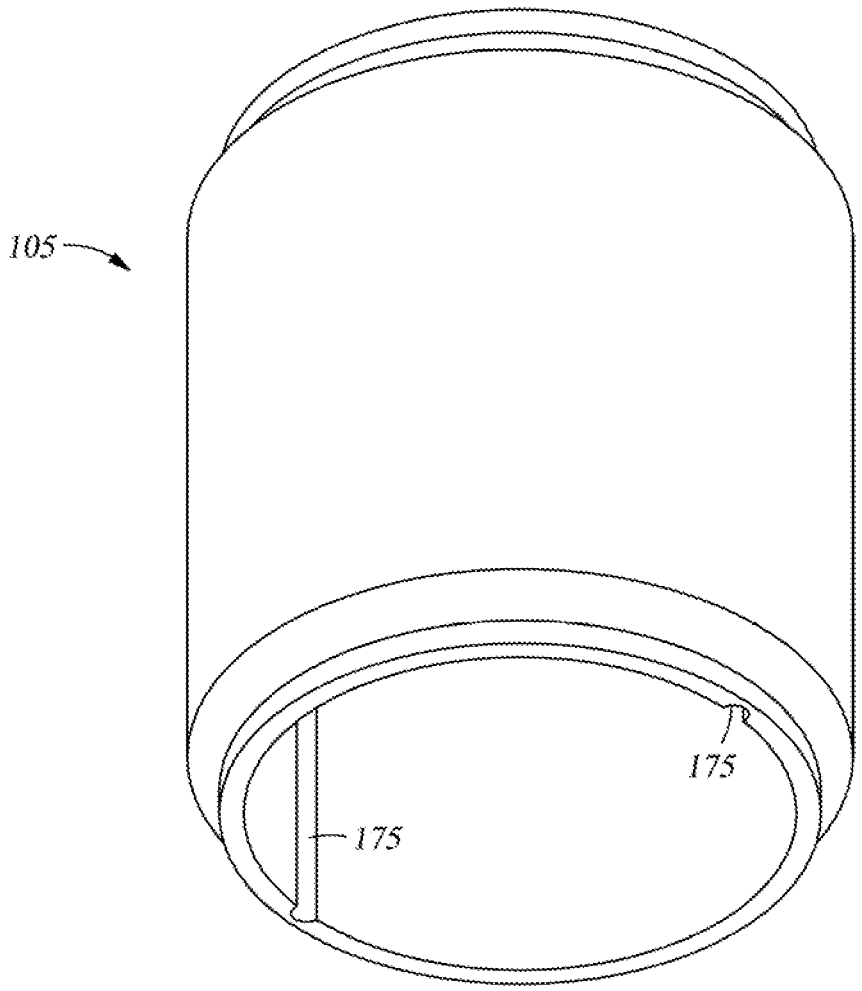
FIG. 5 is a perspective view of an element portion of the tool.
Figure 6:
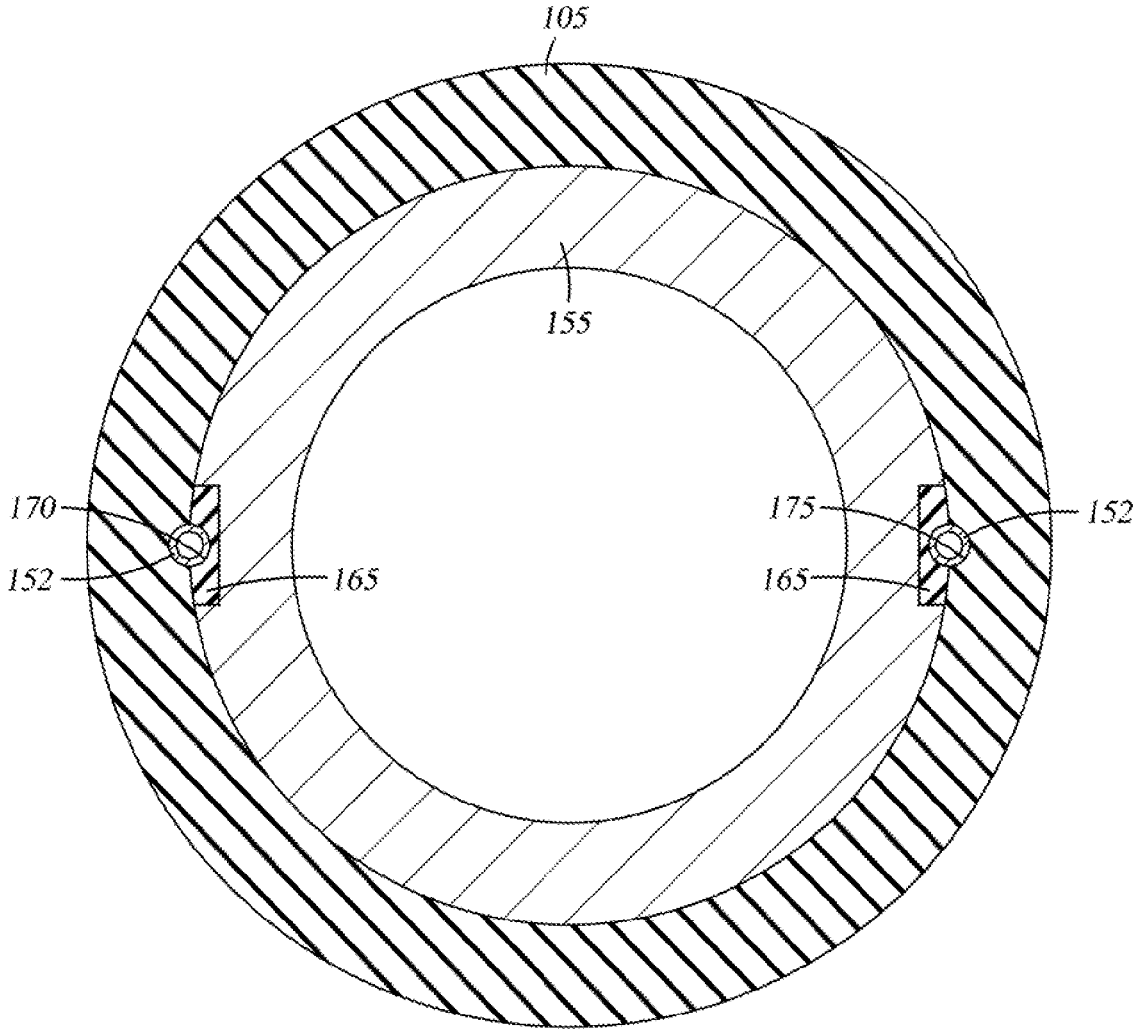
FIG. 6 is a section view of the tool including the enlarged diameter portion of the body, two control lines, an insert installed on a surface of the body for partially retaining the control line, and the cover with a groove formed in an inside surface thereof for partially retaining the control line.

FIG. 5 is a perspective view of the sealing element 105. Like prior art elements, the sealing element is composed of a compressible, resilient/ elastomeric material that can be compressed at its ends in order to expand its outer diameter outwards to seal an annular area between a tool and a wellbore wall. In addition to its sealing duties, the element also serves to cover the control lines 152 with two longitudinally formed grooves 175 in its inner surface designed to house an upper portion of the line 152. In this manner, the line 152 is completely housed between the groove 175 of the sealing element 105 and the groove 170 of the body 150. FIG. 6 is a section view of the enlarged diameter portion 155 of the body and is shown with the sealing element 105 and lines 152 installed. As illustrated, the two lines extend through the tool and each is completely housed in grooves 170, 175.

FIG. 7 is an exploded view of various components of the tool 100, excluding the body 150. At an upper and lower ends are locking rings 135, 140, each of which serve to retain the other components. Each locking ring includes two slots 136, 141 to permit the control lines 152 (not shown) to extend along an outer surface of the tool 100 in the area of the locking rings 135, 140. Adjacent each locking ring are castellated rings 130*a*, 130*b* that are rotationally arranged relative to each other so that petals 131 formed in the body of each ring overlap when they are forced into contact with each other as the tool 100 is set (FIG. 2). In this manner the pairs of castellated rings facilitate the sealing of an annular area between the tool and the wellbore wall. Each castellated ring also includes a passage 132 for each line 152 which are aligned, thereby facilitating the passage of lines through the rings. Adjacent each castellated ring is a deformable sealing ring 125 constructed and arranged to deform in the setting process as shown in FIG. 2. The deformable sealing rings also include passages 126 for the control lines 152 similar to those provided in an inner surface of sealing element 105. Between the deformable sealing rings 125 and each end of the element 105 is a metallic ring 120, also including a passage 121 for each control line 152.

Figure 8:
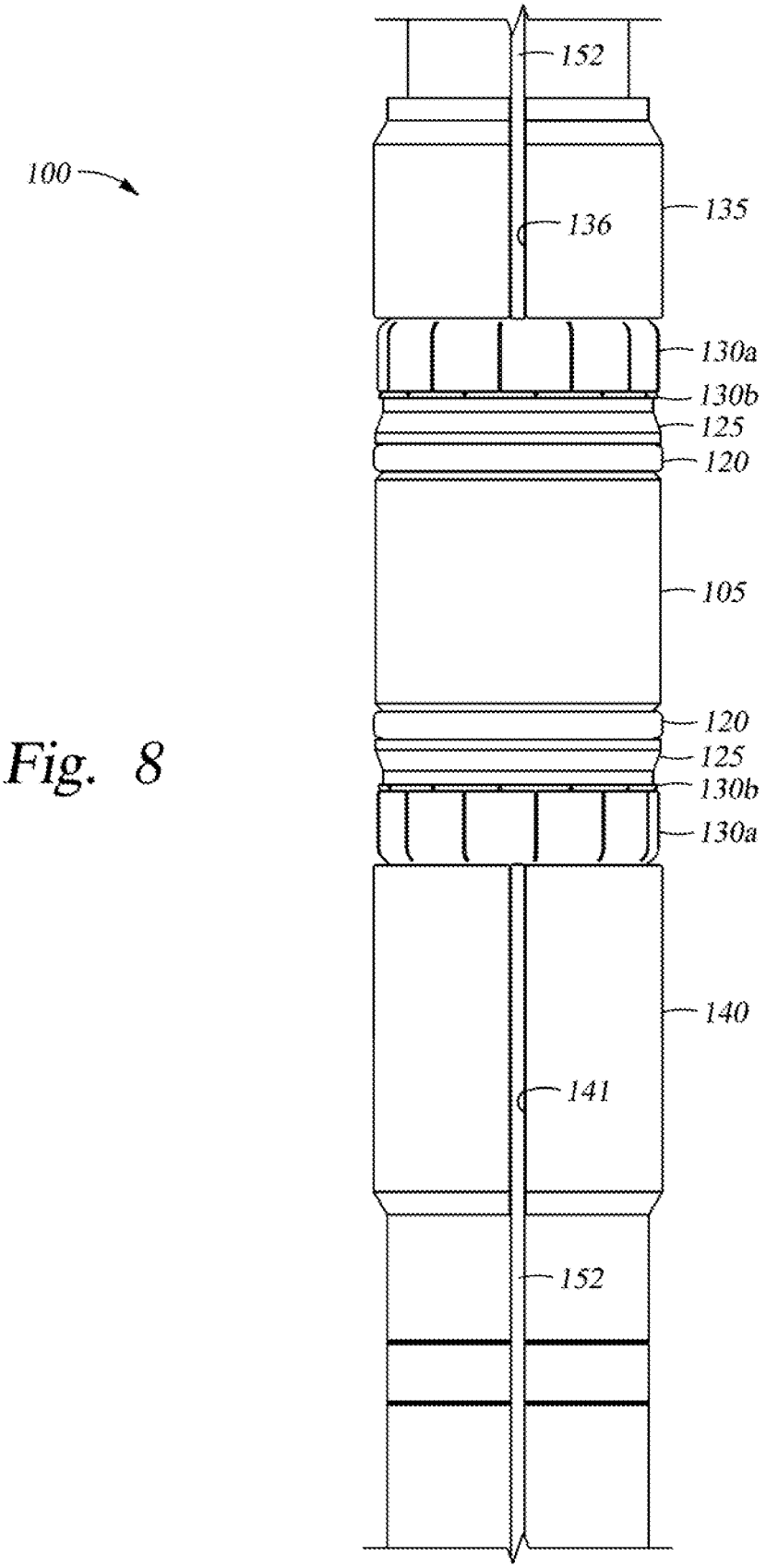
FIG. 8 is a plan view of the tool showing the relationship between the control line and other portions of the tool.

FIG. 8 is a plan view of the assembled tool 100 illustrating the location of the control lines 152 (one visible) relative to the various components. As shown, the lines are on an exterior of the tool 100 or at least exposed to an exterior of the tool in the area of the locking rings 135, 140 as well as the areas above and below the tool. However, the lines are concealed in the area of the rings and element 105. In the embodiment of the tool shown, the control lines 152 run on the interior of the castellated rings 130*a*, 130*b*, the deformable sealing rings 125, and the metallic rings 120, as well as the element 105.

Figure 9:
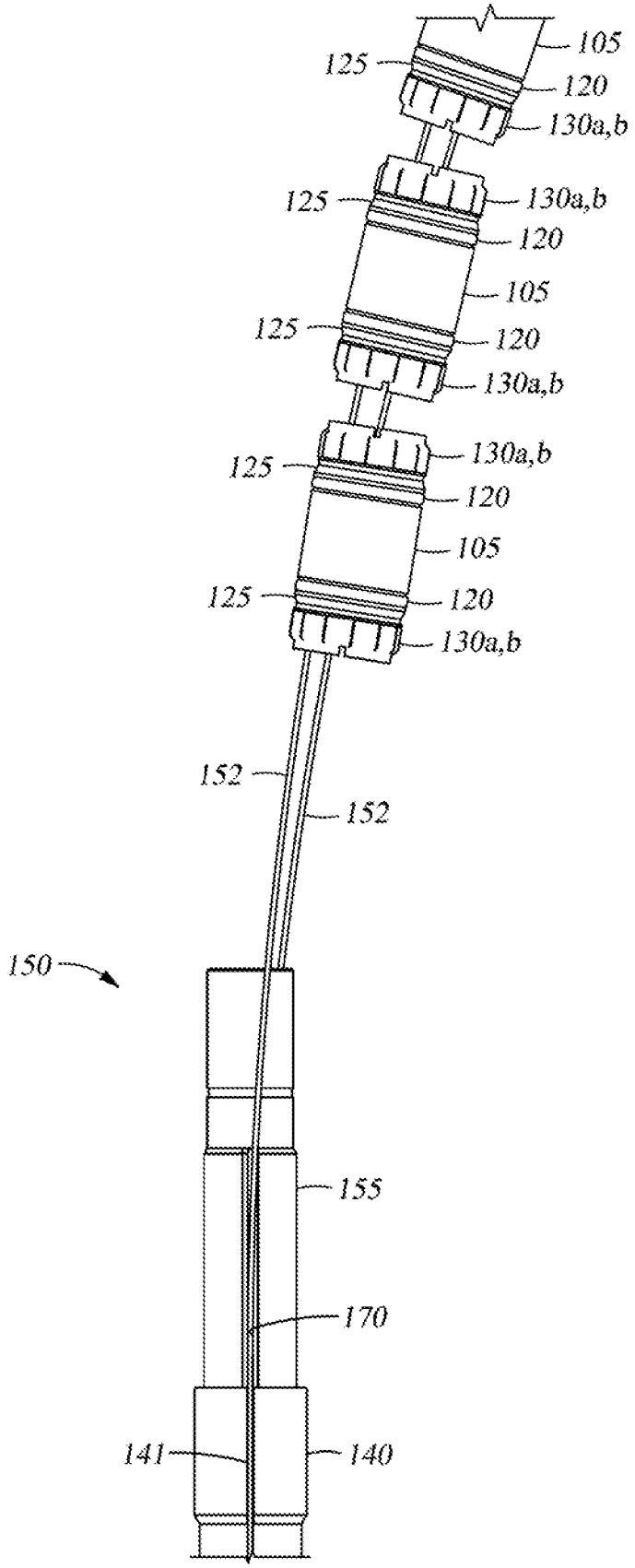
FIGS. 9-11 are schematic views showing the assembly and installation of the tool in a wellbore string of tubulars.
Figure 10:
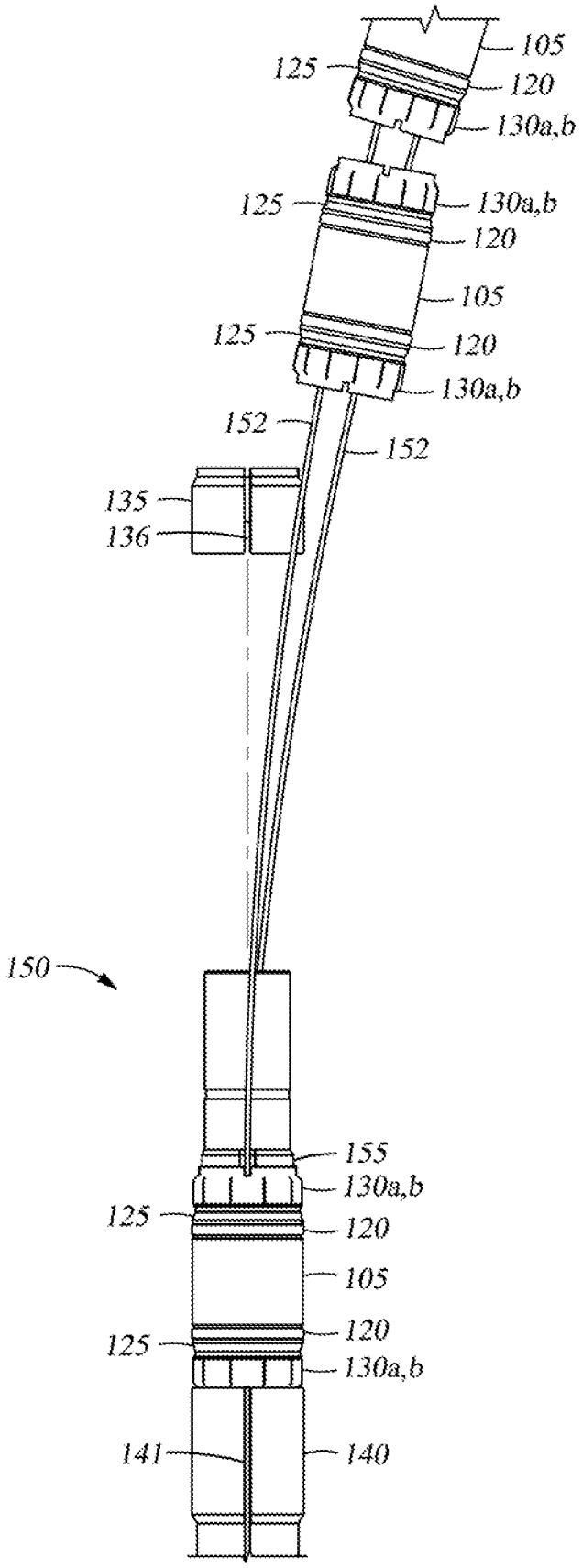
Figure 11:
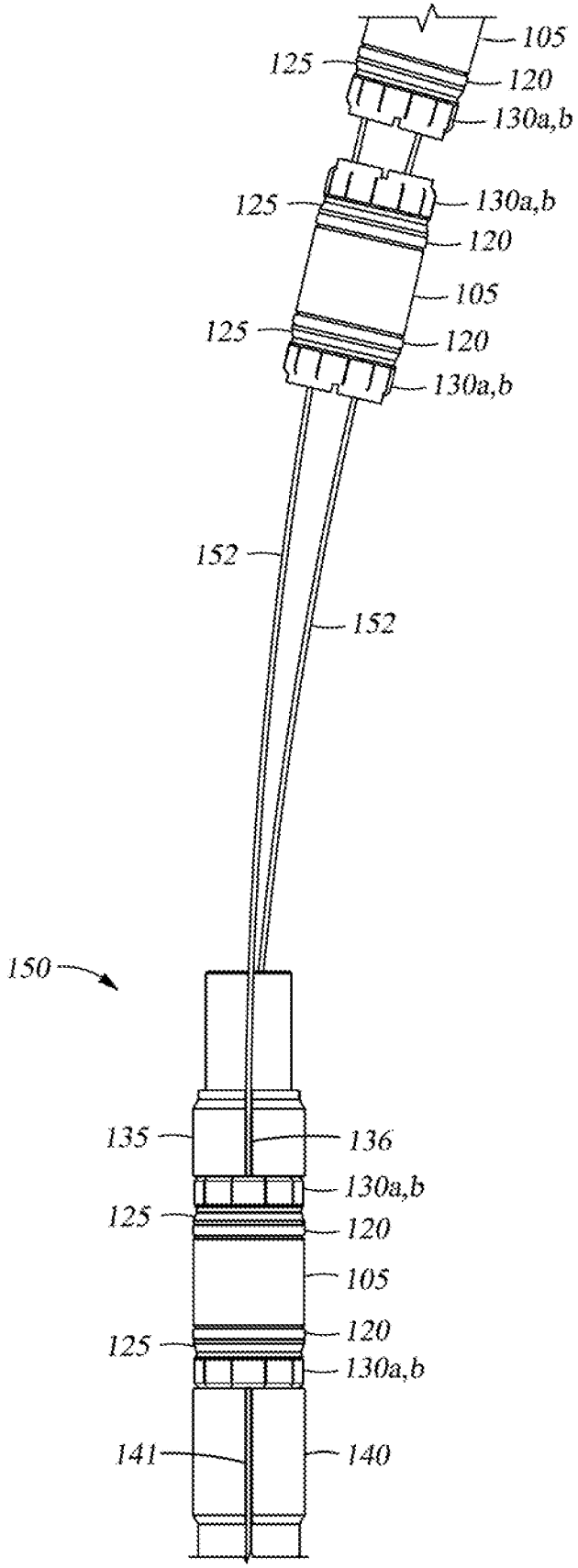

FIGS. 9-11 are schematic views showing the assembly and installation of the tool in a wellbore string of tubulars. In one example a tool according to an embodiment of the invention is installed in a tubular string as follows: The tubular string extends from a wellbore where its weight is retained while additional lengths of tubular are threaded to its upper end (not shown). At a predetermined location in the string, the body 150 of the tool 100, in this case a packer is installed as shown in FIG. 9. The body includes bottom locking ring 140. A slot 141 formed in locking ring 140 is rotationally aligned with a control line groove 170 in the enlarged diameter portion 155 of the body 150. An identical slot and groove are formed on an opposite side of the tool.

Extending from the wellbore are two control lines 152 which typically extend downward to the bottom of the tubular string and are retained along its length with straps or other known means of keeping the lines close to the tubular to avoid damage during run-in and operation. The control lines 152 are typically provided from a pair of reels at the surface of the well. As shown in FIG. 9, the lines are aligned with the string as it extends into the wellbore. In this case, one line 152 is housed within slot 141 and control line groove 170. When installing the packer, certain components are "strung" on the control lines prior to assembly. For example, a group of components including the sealing element 105, castellated rings 130*a, b*, deformable sealing rings 125 and metal rings 120 are threaded onto the control lines and subsequently installed over the body 150 at an axial location along the body where they contact the upper surface of the lower locking ring 140. Assembling tool at the surface of the well with certain components pre-strung on the line is shown in U.S. Pat. No. 7,264,061 and that patent is incorporated herein in its entirety.

Once the group of components are installed on the packer body 150 (FIG. 10), the upper locking ring 135 is installed and secured using a snap ring or other retaining means with the control line groove and slots of the upper and lower locking rings are aligned (FIG. 11). Thereafter the tool 100, installed in the string with the control lines 152 secured therein, is run into the well where it can be actuated (FIG. 2) hydraulically, mechanically or by any other known means.

In one example, a tool string is constructed for fracking one or more zones of a well. Fracking tools are installed at predetermined locations along the string and above and below each is a packer to facilitate the isolation of each zone to be fracked. Fracking tools and their method of use are shown in U.S. Pat. No. 7,926,580 and that patent is incorporated herein in its entirety.

Extending down the well with the string are one or more fiber optic lines. In accordance with the invention, the lines are housed in the packers in a manner ensuring their safety and functionality both before, during and after the fracking jobs are performed. In a typical example, the lines are responsible for transmitted data about wellbore conditions to the surface of the well, especially after frac jobs are performed. For example, data related to pressure, temperature and flow can be collected using sensors and fiber optic transmission. In some instances, the lines transmit conditions present in each zone after that zone is fracked. Downhole measurement systems using a fiber optic differential pressure sensor or velocity sensors are described in U.S. Pat. No. 6,354,147 and that patent is incorporated in reference herein in its entirety.

The tool as described provides an apparatus and method of running multiple lines through a tool in manner whereby they need not be cut or spliced during assembly, run or operation of the tool. Additionally, the tool effectively seals the lines from wellbore fluids and pressures. A single tool has been described but it will be understood that any number of tools could be installed on a string and run into a wellbore and each tool could be operated at anytime thereafter.

While the foregoing is directed to embodiments of the present invention, other and further embodiments of the invention may be devised without departing from the basic scope thereof, and the scope thereof is determined by the claims that follow.

The invention claimed is:

1. A method of deploying a tool in a wellbore, comprising:

installing a tool at an upper end of a tubular string extending from a wellbore, wherein the tool comprises:

a body having an outer surface with at least one longitudinal groove formed therein; and an insert disposed in each of the at least one longitudinal groove, the insert having at least one control line groove formed on an outer surface for housing at least one control line, the at least one control line housed therein;

providing an assembly, the assembly strung on the at least one control line and including:

an element having at least one longitudinal groove formed in an inner surface, wherein the at least one longitudinal groove of the element aligns with the at least one control line groove of the insert; and at least one ring on each end of the element; and installing the assembly over the body, the at least one control line housed between the body and the assembly.

2. The method of claim 1, further comprising providing a lower locking ring at a lower end of the body and an upper locking ring at an upper end of the body, whereby the element and rings are retained on the body between the lock rings.

3. The method of claim 2, wherein the at least one ring includes a metal ring and a deformable ring at each end of the element.

4. The method of claim 3, wherein the at least one ring further includes a pair of castellated rings at each end of the element.

5. The method of claim 2, further comprising running the tool into the wellbore on the tubular string.

6. The method of claim 5, further comprising installing a second tool comprising a body, assembly and upper locking ring at a second location along the tubular string.

7. The method of claim 6, further including installing a fracking tool in the tubular string between the two tools, the fracking tool constructed and arranged to treat a zone defined as an area of the well between the tools.

8. The method of claim 7, further including setting the tools in the wellbore, thereby causing the element of each tool to be compressed and expanded outwards in the direction of a wall of the wellbore, thereby isolating the zone.

9. The method of claim 8, further including treating the zone by fracking.

10. The method of claim 9, further including collecting and transmitting data from the zone via the at least one control line.

11. The method of claim 10, wherein the data includes at least one of pressure, temperature, and flow rate of fluid in the zone.

12. The method of claim 5, further comprising setting the tool in the wellbore at a predetermined location, thereby causing the element to be compressed and expanded outwards in the direction of a wall of the wellbore.

13. A downhole tool, comprising:

a body having an outer surface with a longitudinal groove formed therein;

an insert disposed in the longitudinal groove, wherein the insert includes a control line groove constructed and arranged to house a portion of a control line;

an element, the element having a longitudinal groove in an inside surface thereof, the groove constructed and arranged to house a portion of the control line when the element is installed over the body;

a lower locking ring at a lower end of the element and an upper locking ring at an upper end of the element; and at least one ring at each end of the element, the at least one ring housed between the locking rings.

14. The tool of claim 13, wherein the at least one ring is constructed and arranged to deform when the tool is set.

15. The tool of claim 13, wherein the element is selectively compressed in a wellbore to expand outwards in the direction of a wall of the wellbore.

16. A downhole tool, comprising:

a tubular body having a longitudinal groove formed on an outer surface;

a linear insert disposed in the longitudinal groove on the tubular body, wherein the linear insert includes a control line groove extending a length of the control line groove;

a cylindrical sealing element disposed around the tubular body, wherein the sealing element has a longitudinal groove formed on an inner surface, and the longitudinal groove of the sealing element is aligned with the control line groove of the linear insert to house a control line therebetween;

a lower locking ring configured to couple to the tubular body at a lower end of the sealing element; and an upper locking ring configured to couple to the tubular body on at an upper end of the sealing element.

17. The downhole tool of claim 16, wherein the linear insert is made of an elastomeric material.

18. The downhole tool of claim 17, wherein the sealing element is made of a resilient elastomeric material.

19. The downhole tool of claim 16, wherein each of the upper locking ring and lower locking ring includes a slot to permit the control line to extend along an outer surface of the locking ring to an inner surface of the locking ring.

20. The downhole tool of claim 16, further comprising:

an upper metal ring;

an upper deformable ring, wherein the upper metal ring and the upper deformable ring are disposed on the tubular body between the upper end of the sealing element and the upper locking ring;

a lower metal ring; and a lower deformable ring, wherein the lower metal ring and the lower deformable ring are disposed on the tubular body between the lower end of the sealing element and the lower locking ring.

* * * * *